US009996043B2

(12) United States Patent
Maruyama

(10) Patent No.: US 9,996,043 B2
(45) Date of Patent: Jun. 12, 2018

(54) IMAGE FORMING APPARATUS AND METHOD FOR CONTROL OF SUCTION OF AIR PASSED THROUGH FIXING UNIT

(71) Applicant: KYOCERA Document Solutions Inc., Osaka (JP)

(72) Inventor: Kei Maruyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/670,548

(22) Filed: Aug. 7, 2017

(65) Prior Publication Data

US 2018/0052417 A1 Feb. 22, 2018

(30) Foreign Application Priority Data

Aug. 22, 2016 (JP) ..... 2016-162018

(51) Int. Cl.

| | |
|---|---|
| ***G03G 15/00*** | (2006.01) |
| ***G03G 21/00*** | (2006.01) |
| ***G03G 15/20*** | (2006.01) |
| ***G03G 21/20*** | (2006.01) |

(52) U.S. Cl.

CPC ..... *G03G 15/6573* (2013.01); *G03G 15/2003* (2013.01); *G03G 21/206* (2013.01); *G03G 15/6552* (2013.01); *G03G 2215/00413* (2013.01)

(58) Field of Classification Search

CPC ..... G03G 15/657; G03G 15/6573; G03G 15/6552; G03G 15/2003; G03G 21/206

USPC ..... 399/92, 341

See application file for complete search history.

(56) References Cited

U.S. PATENT DOCUMENTS

| | | | | |
|---|---|---|---|---|
| 5,218,411 | A * | 6/1993 | Kosugiyama | G03G 15/2064 399/341 |
| 7,433,623 | B2 * | 10/2008 | Nakamura | G03G 15/6573 399/107 |
| 2009/0190980 | A1 * | 7/2009 | Tanaka | G03G 15/657 399/397 |
| 2011/0081176 | A1 * | 4/2011 | Masuda | G03G 15/6573 399/341 |
| 2012/0201564 | A1 * | 8/2012 | Masuda | G03G 15/657 399/92 |
| 2013/0228965 | A1 * | 9/2013 | Hoshino | G03G 15/6552 271/211 |

FOREIGN PATENT DOCUMENTS

| | | |
|---|---|---|
| JP | 2006-30415 A | 2/2006 |

* cited by examiner

*Primary Examiner* — Sophia S Chen
(74) *Attorney, Agent, or Firm* — Stein IP, LLC

(57) ABSTRACT

An image forming apparatus has a printing section, a cooling mechanism, a suction adjustment mechanism, and a controller. The printing section includes a fixing unit for heating a sheet having a toner image put on it, and discharges the sheet after fixing. The cooling mechanism includes a suction port, a blower motor for rotating a fan, and a blowing duct for blowing air onto the sheet. The suction adjustment mechanism moves a suction adjustor between an open position where the suction port is open and a shut position where the suction port is closed. The controller moves the suction adjustor the closer to the shut position the smaller the set thickness of the sheet.

9 Claims, 9 Drawing Sheets

| | SPECIFICATIONS | EXAMPLES |
|---|---|---|
| THIN SHEETS | $X1\ g/m^2 \leqq X \leqq X2\ g/m^2$ | |
| AVERAGE SHEETS | $X2\ g/m^2 < X < X3\ g/m^2$ | COPYING PAPER<br>QUALITY PAPER |
| THICK SHEETS | $X3\ g/m^2 \leqq X \leqq X4\ g/m^2$ | ENVELOPES<br>POSTCARDS<br>LABELS |
| N.B. HIGHER FIXING TEMPERATURE WITH THICK SHEETS THAN WITH THIN OR AVERAGE SHEETS. | | |

D1

| | THICK SHEETS | AVERAGE SHEETS | THIN SHEETS |
|---|---|---|---|
| SIMPLEX PRINTING | OPEN POSITION V1=1/2Vo or SHUT POSITION V1=Vo (RELATIVE WIND AMOUNT 2) | OPEN POSITION V1=1/2Vo or SHUT POSITION V1=Vo (RELATIVE WIND AMOUNT 2) | SHUT POSITION V1=1/2Vo (RELATIVE WIND AMOUNT 1) |
| DUPLEX PRINTING | OPEN POSITION, V1=Vo (RELATIVE WIND AMOUNT 4) | OPEN POSITION V1=Vo (RELATIVE WIND AMOUNT 4) | — |

D1

| | THICK SHEETS | AVERAGE SHEETS | THIN SHEETS |
|---|---|---|---|
| SIMPLEX PRINTING | OPEN POSITION V1=1/2Vo or SHUT POSITION V1=Vo (RELATIVE WIND AMOUNT 2) | OPEN POSITION V1=1/2Vo or SHUT POSITION V1=Vo (RELATIVE WIND AMOUNT 2) | SHUT POSITION V1=1/2Vo (RELATIVE WIND AMOUNT 1) |
| DUPLEX PRINTING | OPEN POSITION V1=Vo (RELATIVE WIND AMOUNT 4) | RESTRICTED POSITION V1=Vo (RELATIVE WIND AMOUNT 3) | — |

FIG.16

D1

| | THICK SHEETS | AVERAGE SHEETS | THIN SHEETS |
|---|---|---|---|
| SIMPLEX PRINTING | ONE SUCTION ADJUSTOR AT SHUT POSITION, OTHER AT OPEN POSITION<br>V1=Vo<br>or<br>BOTH SUCTION ADJUSTORS AT OPEN POSITION<br>V1=1/2Vo<br>(RELATIVE WIND AMOUNT 4) | ONE SUCTION ADJUSTOR AT SHUT POSITION, OTHER AT OPEN POSITION<br>V1=Vo<br>or<br>BOTH SUCTION ADJUSTORS AT OPEN POSITION<br>V1=1/2Vo<br>(RELATIVE WIND AMOUNT 4) | 1ST SUCTION ADJUSTOR AT RESTRICTED POSITION<br>2ND SUCTION ADJUSTOR AT SHUT POSITION<br>V1=1/2Vo<br>(RELATIVE WIND AMOUNT 1) |
| DUPLEX PRINTING | 1ST SUCTION ADJUSTOR AT OPEN POSITION<br>2ND SUCTION ADJUSTOR AT OPEN POSITION<br>V1=Vo<br>(RELATIVE WIND AMOUNT 8) | 1ST SUCTION ADJUSTOR AT RESTRICTED POSITION<br>2ND SUCTION ADJUSTOR AT OPEN POSITION<br>V1=Vo<br>(RELATIVE WIND AMOUNT 6) | — |

IMAGE FORMING APPARATUS AND METHOD FOR CONTROL OF SUCTION OF AIR PASSED THROUGH FIXING UNIT

INCORPORATION BY REFERENCE

This application is based upon and claims the benefit of priority from the corresponding Japanese Patent Application No. 2016-162018 filed on Aug. 22, 2016, the entire contents of which are incorporated herein by reference.

BACKGROUND

The present invention relates to an image forming apparatus that cools sheets that have passed through a fixing unit.

Image forming apparatuses employing electrophotography include, for example, multifunction peripherals, printers, copiers, and facsimile machines. An electrophotographic image forming apparatus includes a fixing device. The fixing device fixes toner to a sheet. The sheet that has undergone fixing is discharged onto a discharge tray. If sheets are stacked while they are hot, the discharged sheets may stick to each other. To prevent that, sheets are often cooled by being exposed to wind. There are known techniques for cooling sheets as described below.

There is known a printing device (sheet discharging mechanism) that discharges printed sheets onto an external stacker through a discharge opening, wherein the device includes a blowing nozzle through which wind can be blown onto, over the entire width of, the printed sheets discharged through the discharge opening and a blower for sending wind to the blowing nozzle. This structure is intended to sufficiently cool the sheets that are conveyed.

For the fixing of toner, a sheet is heated in a fixing device up to a temperature at which the toner melts. The sheet is then discharged onto a discharge tray. As sheets are stacked on the discharge tray, the weight (pressure) of upper sheets acts on lower sheets. Stacking a large number of printed sheets on the discharge tray may cause toner to stick to adjacent sheets under the temperature and pressure of the sheets. Thus, sheets can stick to each other. In duplex printing, a sheet passes through the fixing device twice. The amount of heat applied to a sheet is larger in duplex printing than in simplex printing. Sheets are more prone to stick together in duplex printing than in simplex printing. Thick sheets store a larger amount of heat than average sheets. With thick sheets, toner is often fixed at a higher temperature. The higher the temperature at which toner is fixed, the more prone sheets are to stick together.

In addition, recent image forming apparatuses adopt toner with lower melting points than ever. Lowering the melting point of toner helps reduce the output of a heater in the fixing device. This helps save energy (reduce power consumption). Low-melting-point toner sticks to adjacent sheets at a lower temperature than does conventional high-melting-point toner. Thus, the lower the melting point of toner, the more prone sheets stacked on the discharge tray are to stick together.

To prevent sheets on the discharge tray from sticking together, cooling wind is often blown onto the sheets. Thereby the sheets are cooled. Thick sheets storing a large amount of heat or sheets printed on both sides require a larger amount of wind than do thin sheets. On the other hand, blowing a large amount of cooling wind to thin sheets causes them to flutter. This makes a jam more likely, and may cause thin sheets to be discharged unevenly onto the discharge tray. A problem here is that the amount of cooling wind has to be one that is adequate to the thickness of sheets and the amount of heat applied to sheets.

Here, a motor is used to rotate a fan. It is common to adjust the amount of wind by varying the voltage applied to the motor. However, with a voltage equal to or lower than 30% to 40% of the rated voltage, the motor may not start (the fan may not rotate). A problem here is that, through the control of the applied voltage alone, the adjustment width of the amount of wind is narrow, that is, the ratio of the maximal amount of wind to the minimal amount of wind is low).

With the known techniques mentioned above, it is possible to blow wind onto, over the entire width of, sheets. However, no consideration is given to adjusting the amount of wind to suit the situation. Thus, they do not solve the problems mentioned above.

SUMMARY

According to one aspect of the present disclosure, an image forming apparatus includes an operation panel, a printing section, a cooling mechanism, a suction adjustment mechanism, and a controller. The operation panel accepts a setting as to a sheet to be used in printing. The printing section includes an image forming unit, a fixing unit, and a conveying unit. The image forming unit forms a toner image and transfers the toner image to the sheet. The fixing unit heats the sheet having the toner image put thereon and fixes the toner image. The conveying unit conveys the sheet and discharges the sheet after fixing onto a discharge tray. The cooling mechanism includes a blower and a blowing duct. The blower includes a fan, a suction port through which air is taken in, a blower motor that rotates the fan, and a blowout port through which the air taken in through the suction port is blown out. The blowing duct guides the air blown out through the blowout port, and blows the air onto the sheet that has passed through the fixing unit and is discharged out of the apparatus. The suction adjustment mechanism includes a suction adjustor and an actuator. The suction adjustor opens and closes the suction port. The actuator moves the suction adjustor between an open position at which the suction port is open and a shut position at which the suction port is closed. The suction adjustment mechanism adjusts the amount of air blown out through the blowout port by varying the position of the suction adjustor. The controller controls the actuator such that, the smaller the sheet thickness set on the operation panel, the closer the suction adjustor is to the shut position.

Further features and advantages of the present disclosure will become apparent from the description of embodiments given below.

BRIEF DESCRIPTION OF THE DRAWINGS

FIG. 16 is a diagram showing one example of wind amount adjustment data according to the second modified example.

DETAILED DESCRIPTION

Figure 1:
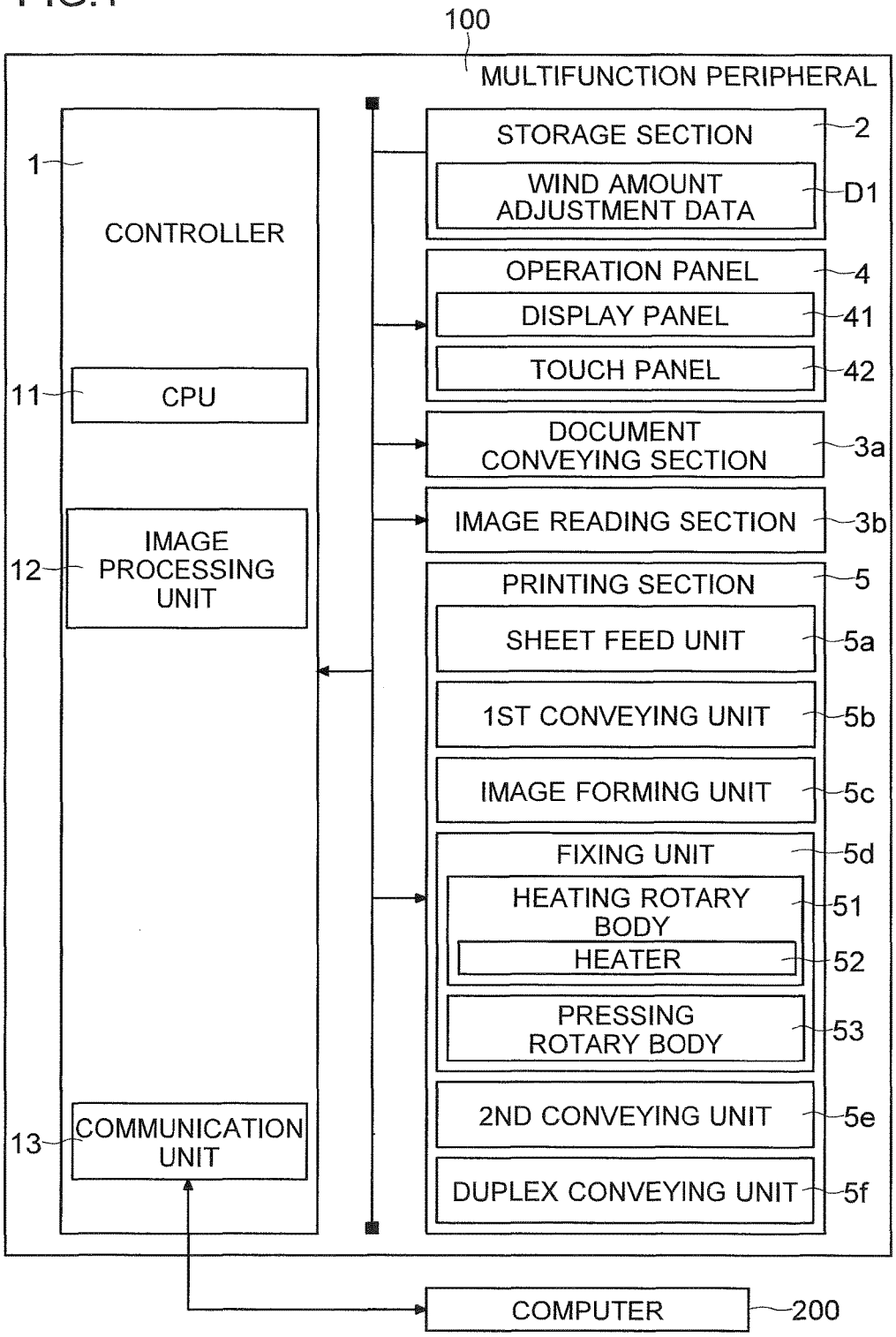
FIG. 1 is a diagram showing one example of a multifunction peripheral according to an embodiment.
Figure 2:
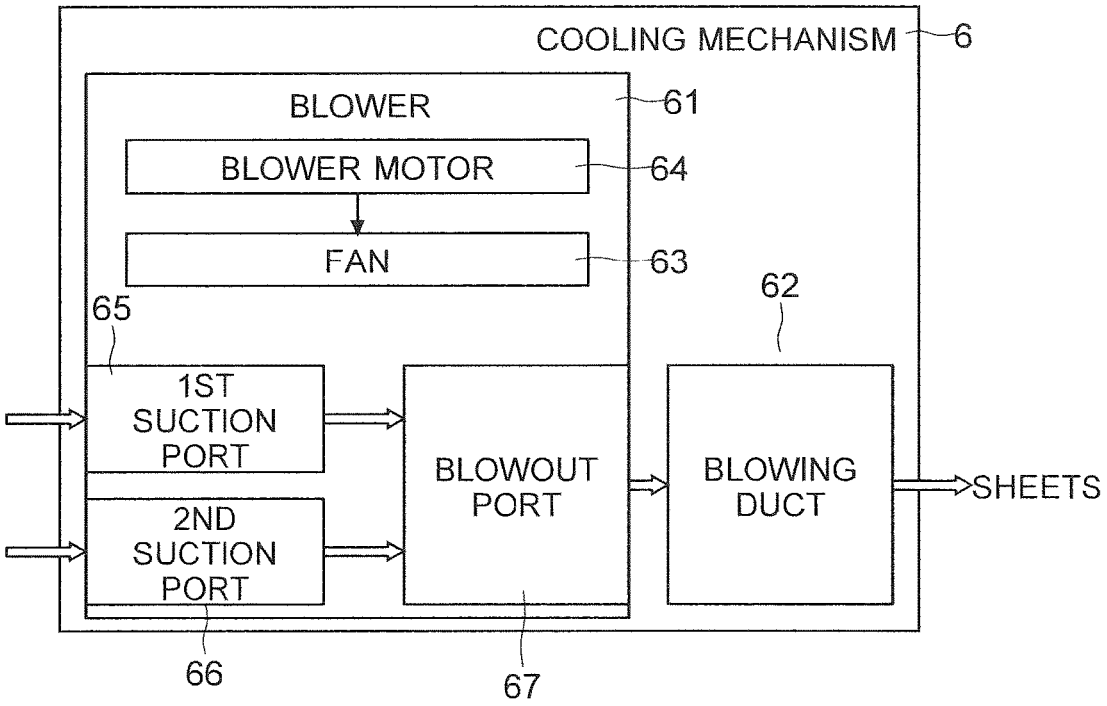
FIG. 2 is a diagram showing one example of a cooling mechanism according to the embodiment.

The present disclosure relates to increasing the adjustment width of the amount of cooling wind. The present disclosure relates to making the amount of cooling wind one that is adequate to the thickness of sheets and the amount of heat applied to sheets. Hereinafter, with reference to FIGS. 1 to 16, an image forming apparatus according to the present disclosure will be described. As an image forming apparatus, a multifunction peripheral 100 will be described as an example. It should however be understood that the structures, arrangements, and other features described herein are not restrictive but merely illustrative.

Outline of Image Forming Apparatus: First, with reference to FIG. 1, a multifunction peripheral 100 according to an embodiment will be described. The multifunction peripheral 100 includes a controller 1 and a storage section 2. The controller 1 governs the operation of the entire apparatus, and controls different parts of the controller 100. The controller 1 includes a CPU 11 and an image processing unit 12. The CPU 11 performs data processing. The image processing unit 12 subjects image data to image processing necessary for printing. The storage section 2 is a storage device that includes ROM, RAM, and a HDD. The storage section 2 stores programs and data for control.

A document conveying section 3*a* conveys a placed document toward a reading position. An image reading section 3*b* reads a document conveyed by the document conveying section 3*a* or a document placed on a document stage (contact glass). The image reading section 3*b* generates image data of the read document. The controller 1 controls the operation of the document conveying section 3*a* and the image reading section 3*b*.

The controller 1 is connected communicably to an operation panel 4. The operation panel 4 includes a display panel 41 and a touch panel 42. The display panel 41 displays information such as the state of the multifunction peripheral 100 and messages. The display panel 41 displays operation images. The operation images include keys, tabs, and buttons. The touch panel 42 is provided for the display panel 41. The touch panel 42 recognizes a touch position. The operation panel 4 accepts operation by a user. For example, the operation panel 4 accepts a setting as to sheets (a setting as to thickness) that are to be used in printing. The operation panel 4 also accepts a setting as to whether to perform duplex printing or simplex printing. Based on the output from the touch panel 42, the controller 1 recognizes the operated operation image, and recognizes what is intended by the operation.

The multifunction peripheral 100 includes a printing section 5. The printing section 5 includes a sheet feed unit 5*a*, a first conveying unit 5*b*, an image forming unit 5*c*, a fixing unit 5*d*, a second conveying unit 5*e*, and a duplex conveying unit 5*f*. The controller 1 controls the operation of the sheet feed unit 5*a*, the first conveying unit 5*b*, the image forming unit 5*c*, the fixing unit 5*d*, the second conveying unit 5*e*, and the duplex conveying unit 5*f*. Thereby the controller 1 controls printing-related processes such as sheet feeding, sheet conveyance, toner image formation, transfer, and fixing.

The sheet feed unit 5*a* accommodates sheets. The controller 1 makes the sheet feed unit 5*a* feed the sheets one by one. The controller 1 makes the first conveying unit 5*b* convey a sheet fed toward the image forming unit 5*c*. The controller 1 makes the image forming unit 5*c* form a toner image to be put on the conveyed sheet. The controller 1 also makes the image forming unit 5*c* transfer the toner image to the sheet. The controller 1 makes the fixing unit 5*d* fix the toner image transferred to the sheet. The controller 1 makes the second conveying unit 5*e* discharge the printed sheet, that is, the sheet having toner image fixed to it, onto a discharge tray 54. The second conveying unit 5*e* includes a discharge roller 55. In duplex printing, the duplex conveying unit 5*f* performs a switchback to reverse top to bottom the sheet having passed through the fixing unit 5*d* and been printed on one side. The duplex conveying unit 5*f* guides (conveys) the top-to-bottom reversed sheet to upstream of the image forming unit 5*c*. This permits a toner image to be transferred to the reverse side of the sheet as well.

The fixing unit 5*d* includes a heating rotary body 51. The heating rotary body 51 includes a heater 52 for heating toner. The fixing unit 5*d* also includes a pressing rotary body 53. The pressing rotary body 53 is kept in pressed contact with the heating rotary body 51. Through the nip between the heating rotary body 51 and the pressing rotary body 53, the sheet having the toner image put on it passes. Thus the sheet is heated and pressed. The toner image is fixed to the sheet.

The multifunction peripheral 100 includes a communication unit 13. The communication unit 13 is an interface for communication with a computer 200. The communication unit 13 communicates with the computer 200 across a network or a cable. The controller 1 is connected to the communication unit 13. The communication unit 13 receives print data from the computer 200. The print data includes data representing content to be printed, such as image data, and data representing settings related to printing. The controller 1 makes the printing section 5 perform printing based on the print data.

Cooling Mechanism 6: Next, with reference to FIGS. 2 to 7, a cooling mechanism 6 for sheets in the multifunction peripheral 100 according to the embodiment will be described. The multifunction peripheral 100 includes a cooling mechanism 6. The cooling mechanism 6 cools a sheet that has been heated while passing through the fixing unit 5*d*. The cooling mechanism 6 includes a blower 61 and a blowing duct 62. The blower 61 includes a fan 63, a blower motor 64 that rotates the fan 63, a first suction port 65 and a second suction port 66 through which air is taken in, and a blowout port 67 through which the air taken in through those suction ports is blown out. As shown in FIGS. 3 to 7, the blower 61 is a sirocco fan that is open at opposite ends (front and rear). One opening serves as the first suction port 65, and the other opening serves as the second suction port 66. The blowing duct 62 guides the air (cooling wind) sucked in through the suction ports and blown out through the blowout port 67. The blowing duct 62 blows the air onto the sheet that has passed through the fixing unit 5*d*.

Figure 3:
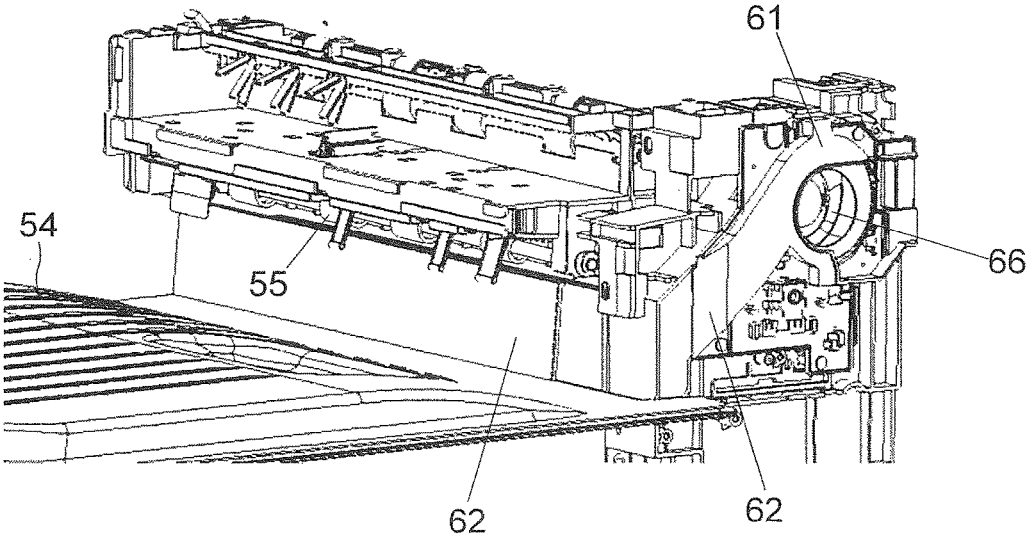
FIG. 3 is a diagram showing one example of a sheet discharging portion in the multifunction peripheral according to the embodiment.

The discharge roller 55 discharges the sheet onto the discharge tray 54. The rotary shaft of the discharge roller 55 is perpendicular to the sheet conveying direction. As shown in FIG. 3, the blower 61 is provided inside the multifunction peripheral 100. The cooling wind from the blowout port 67 is guided through the blowing duct 62 to under the discharge roller 55.

Figure 4:
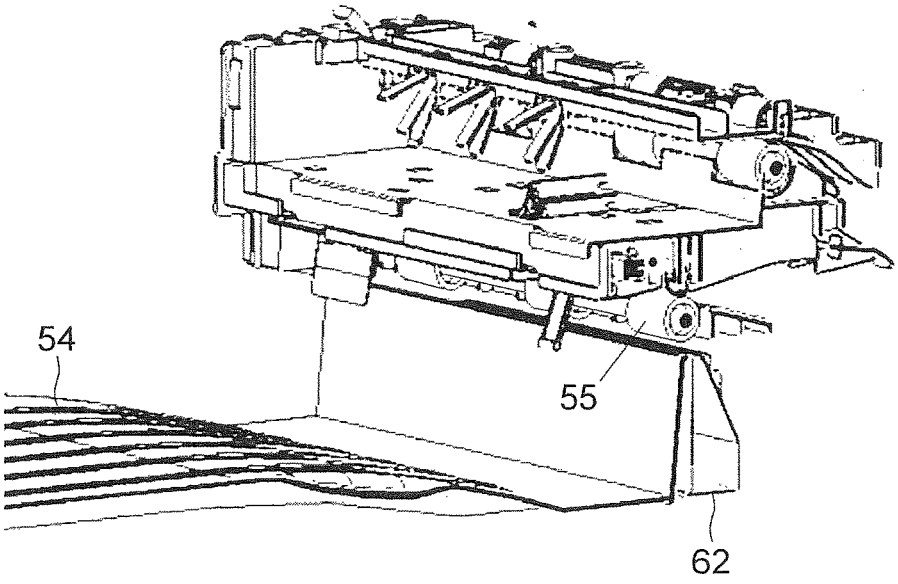
FIG. 4 is a diagram showing one example of the sheet discharging portion in the multifunction peripheral according to the embodiment.
Figure 5:
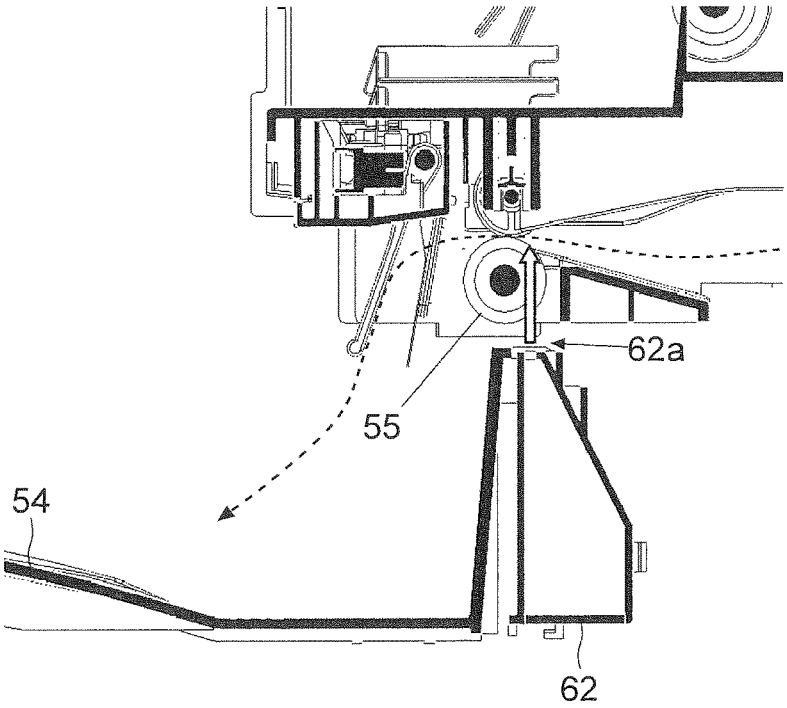
FIG. 5 is a diagram showing one example of the sheet discharging portion in the multifunction peripheral according to the embodiment.

As shown in FIGS. 4 and 5, the blowing duct 62 is provided along the discharge roller 55 under it. Under the discharge roller 55, the blowing duct 62 has a substantially U-shaped cross section. The blowing duct 62 is increasingly narrow upward. The blowing duct 62 is open at the top end. Through the opening 62*a* here, the cooling wind blows toward the sheet. The cooling wind blown out from under the sheet cools the discharged sheet (the sheet that has passed through the fixing unit 5*d*). In FIG. 5, a broken line indicates one example of the sheet discharge direction. On the other hand, a hollow arrow indicates one example of the blowout direction of the cooling wind.

Suction Adjustment Mechanism 7: Next, with reference to FIGS. 6 to 8, one example of a suction adjustment mechanism 7 will be described. The suction adjustment mechanism 7 is a part that adjusts the amount of air sucked in by the blower 61. By adjusting the amount of air sucked in, it is possible to vary the amount of air blown out through the blowout port 67 and the amount of wind (wind pressure) that blows onto the sheet.

One of the first and second suction ports 65 and 66 is provided with a suction adjustor 8 (lid). The suction adjustor 8 is a lid on the suction port. The following description deals with an example where the first suction port 65 is provided with the suction adjustor 8. Instead, the second suction port 66 may be provided with the suction adjustor 8. By moving the suction adjustor 8, it is possible to close (stop) the first suction port 65.

For a given rotation rate of the blower motor 64, the amount of wind with the first suction port 65 closed is one-half or approximately one-half of the amount of wind with the first suction port 65 open. In other words, the amount of air sucked in with both suction ports open is twice or approximately twice the amount of air sucked in with only the second suction port 66 open. The opening areas of the first and second suction ports 65 and 66 are equal or approximately equal.

To enable the suction adjustor 8 to move between a shut position and an open position, an actuator 9 is provided. The shut position is the position of the suction adjustor 8 at which it closes the first suction port 65. The shut position is the position of the suction adjustor 8 at which the amount of air sucked in through the first suction port 65 is zero. The open position is the position of the suction adjustor 8 at which it opens the first suction port 65 and at which the amount of air sucked in (suction efficiency) is 100%. The open position can be said to be the position of the suction adjustor 8 at which the amounts of air sucked in through the first and second suction ports 65 and 66 are equal. The open position can be said to be the position of the suction adjustor 8 at which suction of air through the first suction port 65 is not obstructed. The open position is the position of the suction adjustor 8 at which the suction adjustor 8 is taken apart from the first suction port 65 by a predetermined distance or more. The predetermined distance is a distance equal to or larger than the distance that does not obstruct suction of air through the first suction port 65.

Figure 6:
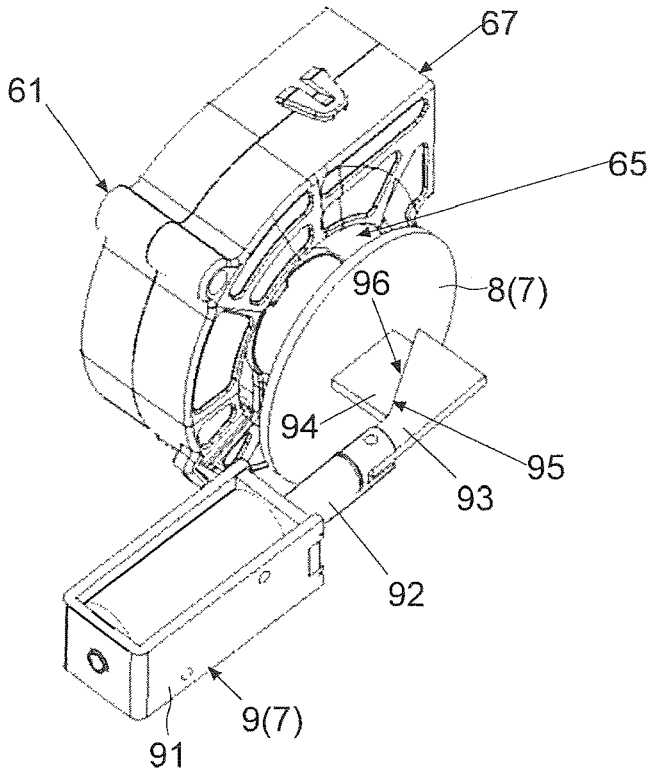
FIG. 6 is a diagram showing one example of a blower according to the embodiment.
Figure 7:
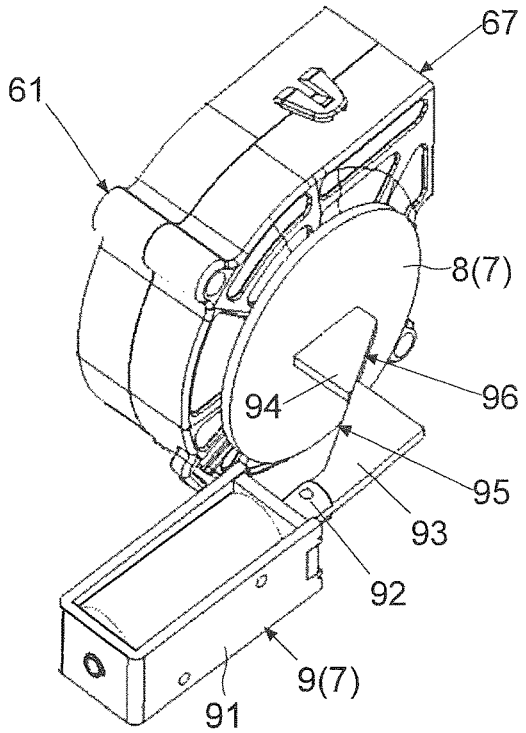
FIG. 7 is a diagram showing one example of the blower according to the embodiment.

As shown in FIGS. 6 and 7, the actuator 9 can be a solenoid 91. The movement direction of a moving core 92 of the solenoid 91 is parallel to the plane of the suction adjustor 8 (the air suction plane of the blower 61, the direction perpendicular to the movement direction of the suction adjustor 8). A first oblique-side member 93 is attached to the tip end of the moving core 92. A second oblique-side member 94 is attached to the outer surface of the suction adjustor 8 (on the side opposite from the first suction port 65). An oblique-side portion 95 of the first oblique-side member 93 and an oblique-side portion 96 of the second oblique-side member 94 are parallel to each other, and make contact with each other.

Figure 8:
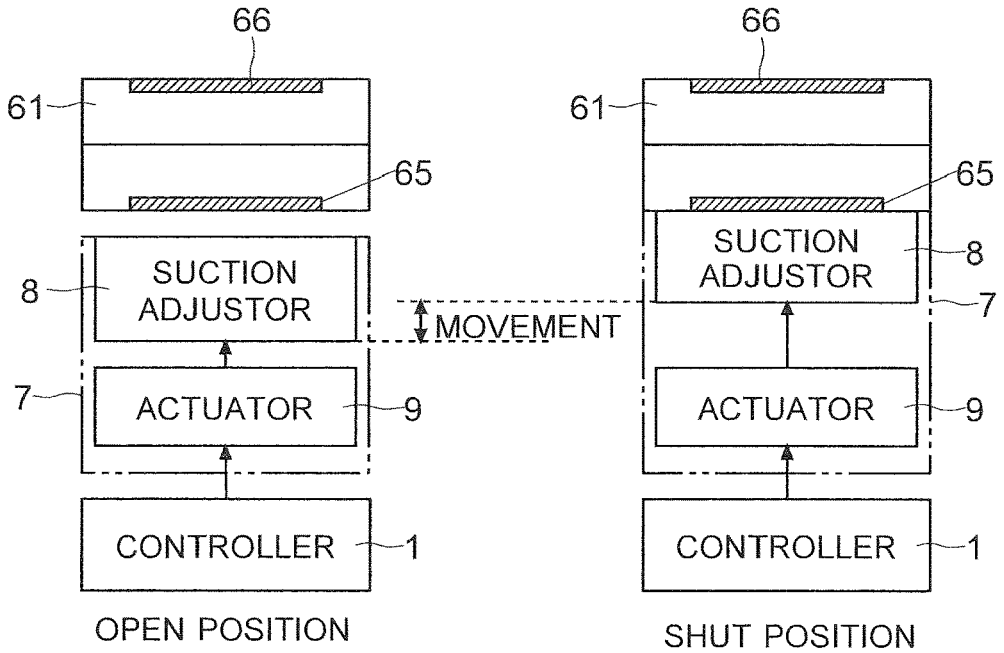
FIG. 8 is a diagram showing one example of a suction adjustment mechanism according to the embodiment.

The suction adjustor 8 is biased in the direction away from the first suction port 65. A biasing member such as a spring is used (not shown in FIGS. 6 and 7). With the moving core 92 in a protracted state, the amount (push-in amount) by which the first oblique-side member 93 pushes in the second oblique-side member 94 in the direction of the first suction port 65 is minimal (the state in FIG. 6). That is, when the moving core 92 is in the protracted state, the suction adjustor 8 is at the open position. With the moving core 92 in the retracted state, the push-in amount is maximal. That is, when the moving core 92 is in the retracted state, the suction adjustor 8 is at the shut position (the state in FIG. 7). As the moving core 92 is retracted, the first oblique-side member 93, the second oblique-side member 94, and the suction adjustor 8 move. The first suction port 65 is closed by the suction adjustor 8. As shown in FIG. 8, the controller 1 controls the actuator 9. Thereby the controller 1 controls the position of the suction adjustor 8.

Figure 9:
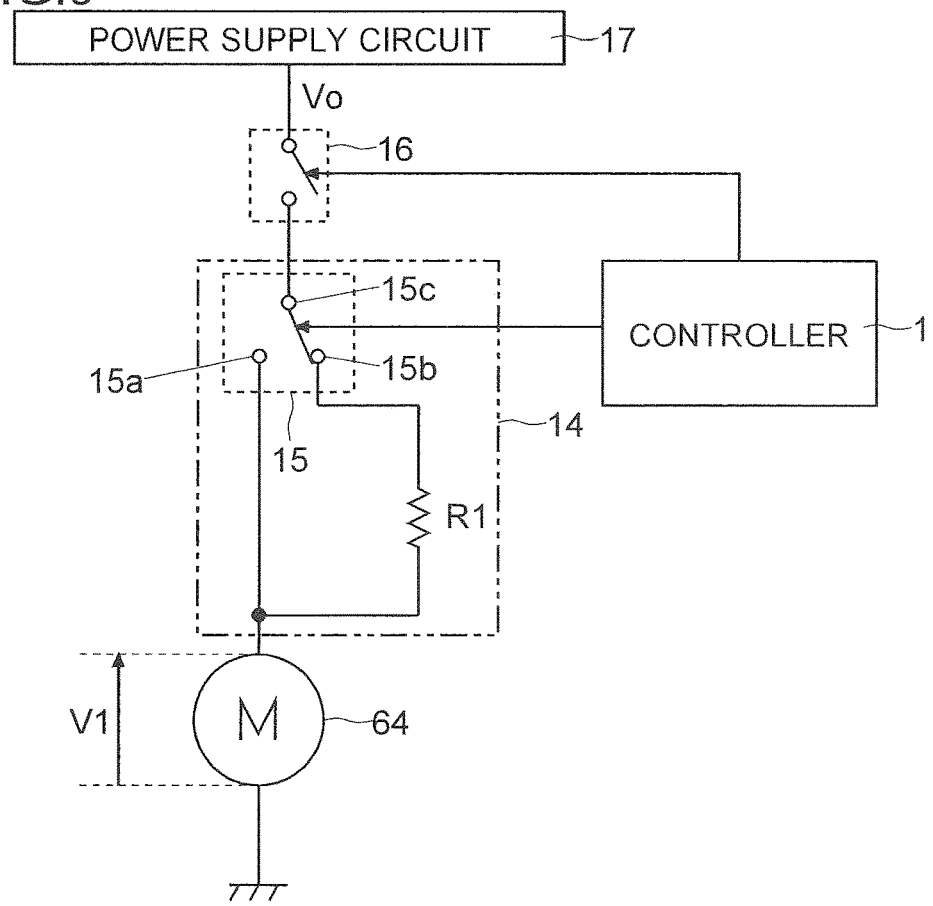
FIG. 9 is a diagram showing one example of a voltage adjuster according to the embodiment.

Voltage Adjuster 14: Next, with reference to FIG. 9, one example of a voltage adjuster 14 according to the embodiment will be described. The voltage adjuster 14 is a circuit that varies a motor voltage V1. The motor voltage V1 is applied to the blower motor 64 of the blower 61. As shown in FIG. 9, the voltage adjuster 14 includes a first switch 15 and a resistor R1. The first switch 15 is a one-input two-output switch. The first switch 15 connects an input terminal 15*c* to either a first output terminal 15*a* or a second output terminal 15*b*.

The input terminal 15*c* of the first switch 15 is connected via a second switch 16 to a power supply circuit 17. The power supply circuit 17 is a circuit that generates and outputs an operating voltage for the blower motor 64. The output voltage Vo of the power supply circuit 17 is, for example, DC 24 V. The second switch 16 is a switch for turning on and off the blower motor 64. To rotate the fan 63, the controller 1 turns the second switch 16 on (into a conducting state). To keep the fan 63 from rotating (in a non-printing state), the controller 1 turns the second switch 16 off (into a non-conducting state).

The output of the power supply circuit 17 is connected to the input terminal of the second switch 16. The output terminal of the second switch 16 is connected to the input terminal 15*c*. The first output terminal 15*a* is connected to one terminal of the blower motor 64. The second output terminal 15*b* is connected to one end of the resistor R1. The other end of the resistor R1 is connected to one terminal of the blower motor 64. The other terminal of the blower motor 64 is connected to ground.

With the input terminal 15*c* connected to the first output terminal 15*a*, the output voltage Vo (the output of the power supply circuit 17) is applied to the blower motor 64. With the input terminal 15*c* connected to the second output terminal 15*b*, a voltage resulting from voltage division of the output voltage Vo between the resistor R1 and the resistance across the blower motor 64 is applied to the blower motor 64. In the multifunction peripheral 100, the resistor R1 and the blower motor 64, across it, have equal resistance values. Accordingly, with the input terminal 15*c* connected to the second output terminal 15*b*, one-half of Vo (for example, DC 12 V) is applied to the blower motor 64.

The controller 1 controls the first switch 15. With the first suction port 65 open, the amount of wind with the motor voltage V1 at ½Vo is one-half or approximately one-half of the amount of wind with the motor voltage V1 at Vo. The blower motor 64 rotates at a rotation rate that varies in proportion to the applied voltage. The blower motor 64 is, for example, a DC brush motor.

Sheet Settings: Next, with reference to FIG. 10, one example of sheet settings in the multifunction peripheral 100 according to the embodiment will be described. The thickness of sheets to be used in printing (the sheets stored in the sheet feed unit 5*a*) can be set on the operation panel 4. Sheets are classified according to thickness into, for example, thin sheets, average-thickness sheets, and thick sheets. By operating the operation panel 4 in a predetermined manner, it is possible to make a setting as to the thickness (thin, average, or thick) of sheets. Based on the setting made on the operation panel 4, the controller 1 recognizes the thickness of sheets to be used in printing.

Figures 10, 11:
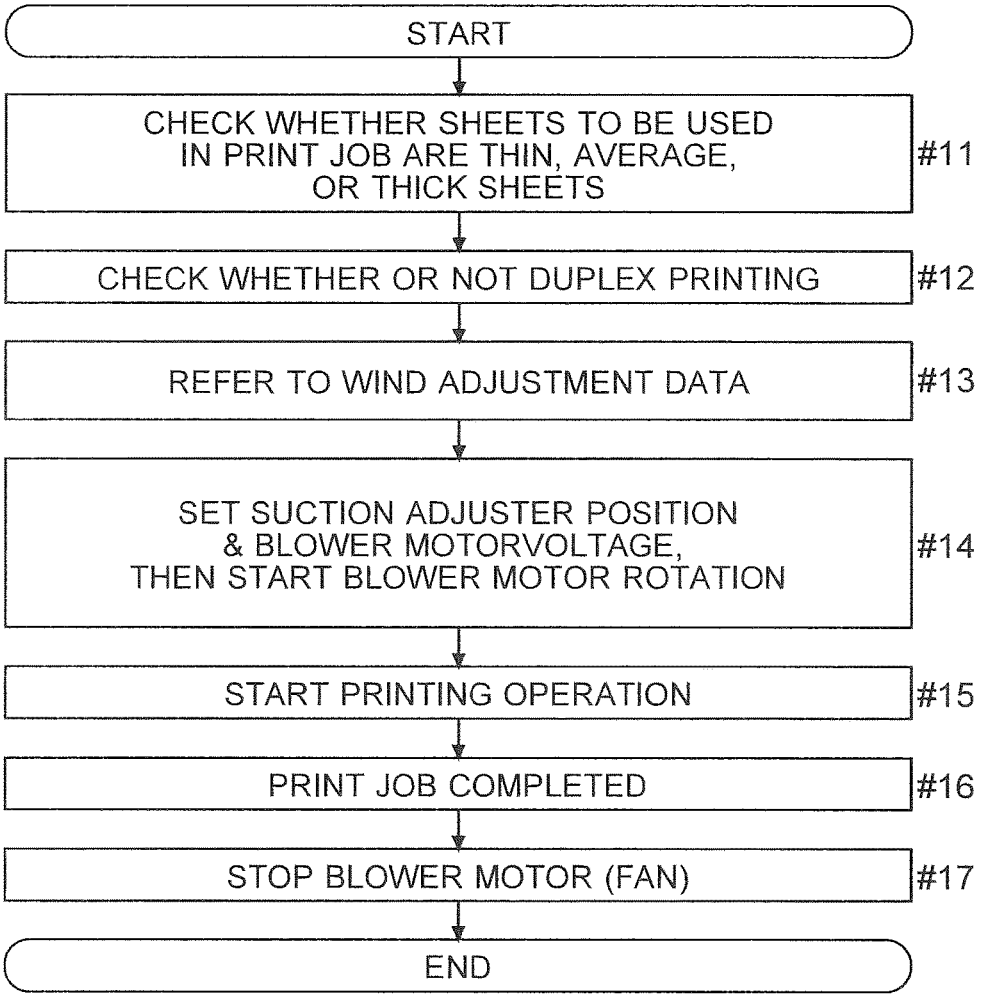
FIG. 10 is a diagram showing one example of sheet settings in the multifunction peripheral according to the embodiment.
FIG. 11 is a flow chart showing one example of a flow for wind amount adjustment in the multifunction peripheral according to the embodiment.

As shown in FIG. 10, what sheets to handle as thin, average, and thick sheets according to their thickness is formulated in the apparatus specifications, though varying from model to model. In one example, the variables X1, X2, X3, and X4 in FIG. 10 have the values X1 =52, X2 =59, X3 =106, and X4 =256. Here, X represents the weight of a sheet per square meter. Based on the apparatus specifications, the user sets the thickness of the sheets stored in the sheet feed unit 5*a*. As shown in FIG. 10, commonly available office-use sheets (for example, photocopying paper, quality paper, and recycled paper) are mostly average sheets. On the other hand, envelopes, postcards, and labels are mostly thick sheets. As shown in FIG. 10, for printing on thick sheets, the controller 1 can raise the temperature of the heating rotary body 51 (the output of the heater 52) compared with that with average or thin sheets.

Wind Amount Adjustment During Printing: Next, with reference to FIGS. 11 and 12, one example of wind amount adjustment during printing in the multifunction peripheral 100 according to the embodiment will be described.

The flow in FIG. 11 starts when a print job starts. The print job is, for example, a copying job or a printing job. At the start, selections have been made as to whether to perform duplex or simplex printing and which sheet feed unit 5*a* to use. These settings are made on the operation panel 4 or the computer 200 that is communicably connected to and the communication unit 13. Moreover, on the operation panel 4, a setting as to the thickness of the sheets stored in the sheet feed unit 5*a* has already been made. In the multifunction peripheral 100, duplex printing on thin sheets is prohibited (unexecutable). This is because that tends to cause a sheet jam (clogging). Accordingly, from the operation panel 4 or the computer 200, duplex printing cannot be performed on a sheet fed from a sheet feed unit 5*a* that accommodates thin sheets.

The controller 1 checks whether the sheets to be used in the print job are thick, average, or thin sheets (step #11). The controller 1 checks the sheet thickness that has previously been set on the operation panel 4 for the sheet feed unit 5*a* from which sheets will be fed for the print job. The controller 1 checks whether the print job is duplex printing or not (whether it is duplex or simplex printing) (step #12). The controller 1 refers to wind amount adjustment data D1 stored in the storage section 2 (step #13; see FIG. 1). Based on what is defined in the wind amount adjustment data D1, the controller 1 sets the position of the suction adjustor 8 and the level of the motor voltage V1 (step #14). Then the controller 1 makes the blower motor 64 start to rotate (step #14). The controller 1 controls the actuator 9 to adjust the position of the suction adjustor 8, and controls the voltage adjuster 14 to adjusts the motor voltage V1.

Figures 12, 13:
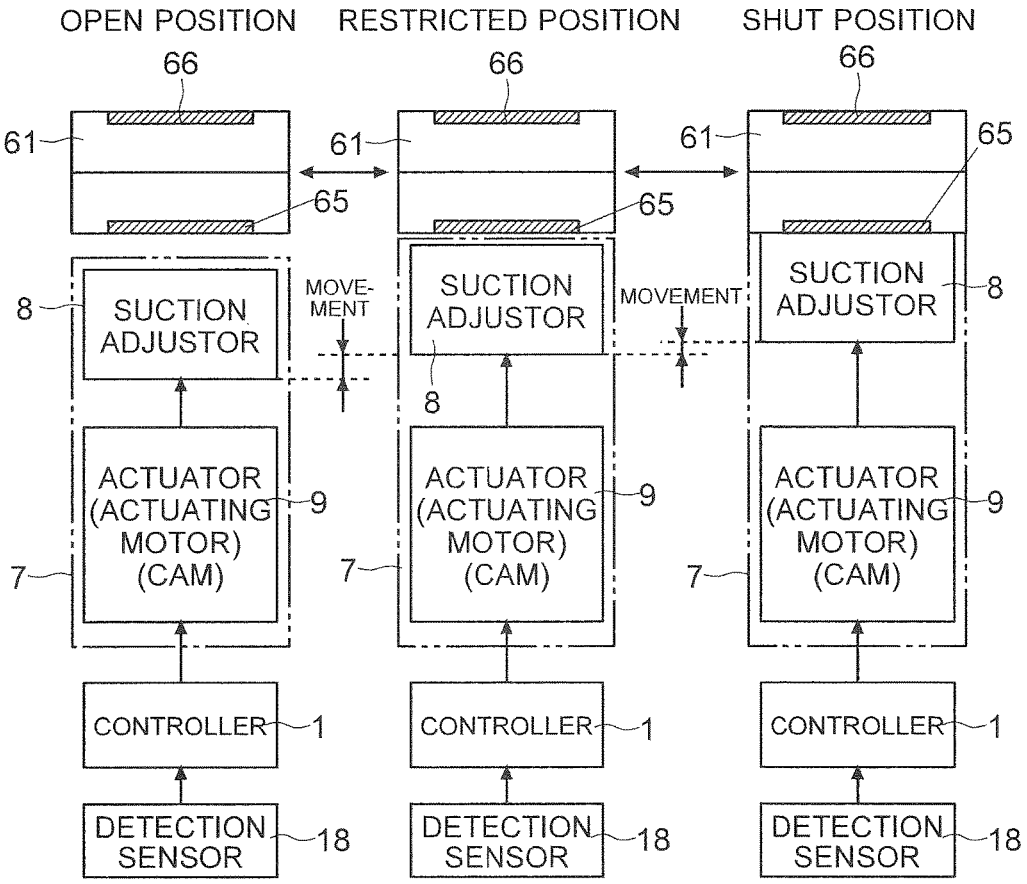
FIG. 12 is a diagram showing one example of wind amount adjustment data according to the embodiment.
FIG. 13 is a diagram showing one example of a suction adjustment mechanism according to a first modified example.

FIG. 12 shows one example of the wind amount adjustment data D1. As shown in FIG. 12, for simplex printing on thin sheets, the controller 1 sets the suction adjustor 8 at the shut position and sets the motor voltage V1 at ½Vo (so that the amount of wind is minimal). For duplex printing on thick or average sheets, the controller 1 sets the suction adjustor 8 at the open position and sets the motor voltage V1 at Vo (so that the amount of wind is maximal). For simplex printing on thick or average sheets, the controller 1 can set the suction adjustor 8 at the shut position and set the motor voltage V1 at Vo. Or the controller 1 can set the suction adjustor 8 at the open position and set the motor voltage V1 at ½Vo.

Closing one suction port halves the amount of wind. Likewise, halving the motor voltage V1 halves the amount of wind. Let the amount of cooling wind for simplex printing on thin sheets be 1. Then, the amount of cooling wind for simplex printing on thick or average sheets is 2. The amount of cooling wind for duplex printing on thick or average sheets is 4. The ratio of the maximal amount of wind to the minimal amount of wind is 4:1. The wind amount ratio is thus higher than in a case where the amount of wind is adjusted solely by varying the voltage applied to the blower motor 64. It is possible to blow a gentle cooling wind onto thin sheets so as not to cause them to flutter. It is also possible to blow onto thick or average sheets an amount of cooling wind that is adequate to the amount of heat that has been applied to them (the number of faces printed).

The controller 1 makes the printing section 5 start printing operation (step #15). This starts sheet feeding by the sheet feed unit 5*a*, sheet conveyance by the sheet conveying units, toner image formation and transfer by the image forming unit 5*c*, and fixing by the fixing unit 5*d*. Shortly the print job is completed (step #16). Now the printing operation by the printing section 5 stops. The controller 1 stops the blower motor 64. The controller 1 stops cooling sheets (step #17, then END).

As described above, the multifunction peripheral 100 (image forming apparatus) according to the embodiment includes an operation panel 4, a printing section 5, a cooling mechanism 6, a suction adjustment mechanism 7, and a controller 1. The operation panel 4 accepts a setting as to sheets to be used in printing. The printing section 5 includes an image forming unit 5*c*, a fixing unit 5*d*, and conveying units. The image forming unit 5*c* forms a toner image and transfers it to a sheet. The fixing unit 5*d* heats the sheet having the toner image put on it and fixes the toner image. The conveying units convey the sheet and discharge the sheet after fixing onto a discharge tray 54. The cooling mechanism 6 includes a blower 61 and a blowing duct 62. The blower 61 includes a fan 63, a suction port through which to take in air, a blower motor 64 that rotates the fan 63, and a blowout port 67 through which to blow out the air taken in through the suction port as the fan 63 rotates. The blowing duct 62 guides the air blown out through the blowout port 67. The blowing duct 62 blows the air onto the sheet that has passed through the fixing unit 5*d* and is discharged out of the apparatus. The suction adjustment mechanism 7 includes a suction adjustor 8 and an actuator 9. The suction adjustor 8 opens and closes the suction port. The actuator 9 moves the suction adjustor 8 between an open position, where the suction port is open, and a shut position, where the suction port is closed. The suction adjustment mechanism 7 adjusts the amount of wind blown out through the blowout port 67 by changing the position of the suction adjustor 8. The controller 1 controls the actuator 9 such that, the smaller the sheet thickness set on the operation panel 4, the closer the suction adjustor 8 is to the shut position.

It is thus possible to reduce the amount of air sucked in and reduce the amount of cooling wind the thinner the sheets used in printing. This prevents thin sheets from fluttering while being conveyed. Reversely, it is possible to increase the amount of air sucked in the thicker the sheets used in printing. This helps increase the amount of cooling wind. It is possible to make the amount of cooling wind adequate to the amount of heat stored in sheets. Moreover, it is possible to adjust the amount of cooling wind simply by moving the suction adjustor 8. It is thus possible to easily make the amount of cooling wind adequate to the thickness of sheets and the amount of heat applied.

The multifunction peripheral 100 further includes a voltage adjuster 14. The voltage adjuster 14 varies the motor voltage V1 applied to the blower motor 64. The blower 61 has, as the suction port, a first suction port 65 and a second suction port 66. One of the first and second suction ports 65 and 66 is provided with the suction adjustor 8. The printing section 5 includes a duplex conveying unit 5*f* that guides a sheet printed on one side to upstream of the image forming unit 5*c* for duplex printing. The operation panel 4 accepts a setting as to whether to perform simplex printing or duplex printing. The controller 1 controls the voltage adjuster 14. Based on the setting made on the operation panel 4, the controller 1 recognizes whether the sheets to be used in printing are thick, average, or thin sheets. For simplex printing on thin sheets, the controller 1 sets the suction adjustor 8 at a shut position and sets the motor voltage V1 lower than for duplex printing on thick or average sheets. For duplex printing on thick or average sheets, the controller 1 sets the suction adjustor 8 at an open position and sets the motor voltage V1 higher than for simplex printing on thin sheets. Thus, in simplex printing on thin sheets, the amount of cooling wind can be reduced to the minimal level. In duplex printing on sheets (thick or average sheets) thicker than thin sheets, the amount of air sucked in is increased and the motor voltage V1 is increased. Thus, the amount of cooling wind can be increased to the maximum level. It is possible to sufficiently cool thick or average sheets that have been printed on both sides. Moreover, it is possible to adjust the amount of wind by controlling two factors: the position of the suction adjustor 8 and the motor voltage V1. This helps increase the adjustment width of the amount of cooling wind (increase the ratio of the maximal amount of wind to the minimal amount of wind).

On the other hand, for simplex printing on thick or average sheets, the controller 1 can set the suction adjustor 8 at the shut position and set the motor voltage V1 at the same voltage as for duplex printing on thick or average sheets. Or, the controller 1 can set the motor voltage V1 at the same voltage as for simplex printing on thin sheets and set the suction adjustor 8 at the open position. It is thus possible to make the amount of cooling wind in simplex printing on thick or average sheets smaller than in duplex printing but larger than in simplex printing on thin sheets. It is thus possible to make the amount of cooling wind adequate to the thickness of sheets and the amount of applied heat. Thus, cooling does not require an unnecessary amount of air. Thus, no electric power is consumed unnecessarily.

The actuator 9 is a solenoid 91. The controller 1 turns the solenoid 91 on and off to set the suction adjustor 8 at the open or shut position. It is thus possible to adjust the amount of cooling wind with a simple configuration.

First Modified Example: Next, with reference to FIGS. 13 and 14, a first modified example will be described. The following description focuses on differences from the embodiment described previously. For features common to the first modified example and the embodiment described previously, reference is to be made to the relevant parts of what has already been described, and no overlapping description will be repeated.

The first modified example differs from the embodiment described previously in the suction adjustment mechanism 7. In the embodiment described previously, the suction adjustor 8 is located either at the shut position or at the open position. In the first modified example, the suction adjustor 8 can be located also at a position (restricted position) between the shut position and the open position. Also in the first modified example, the suction adjustor 8 is biased in the direction away from the first suction port 65 with a biasing member such as a spring. FIG. 13 shows, in the middle, one example of the restricted position. For example, at the restricted position, the amount of air sucked in through the first suction port 65 is 50% of that at the open position. The controller 1 controls the actuator 9. The controller 1 can keep the suction adjustor 8 at any of the shut, open, and restricted positions.

To enable the suction adjustor 8 to be kept at the restricted position, the actuator 9 is configured differently than in the embodiment described previously. For example, the actuator 9 can comprise an actuating motor and a cam. The cam rotates by being driven by the actuating motor. Here, the cam lies in contact with the suction adjustor 8. The controller 1 controls the rotation angle of the cam, and thereby varies the distance between the first suction port 65 and the suction adjustor 8. A detection sensor 18 may be provided. The detection sensor 18 detects the position of the suction adjustor 8 (detects the rotation angle of the cam). Instead of a cam, a worm gear and a worm may be used to vary the distance between the first suction port 65 and the suction adjustor 8.

Also in the first modified example, in a print job, a process similar to the wind amount adjustment process shown in the flow chart in FIG. 11 is performed. In the first modified example, different wind amount adjustment data D1 is referred to at step #13.

Figures 14, 15:
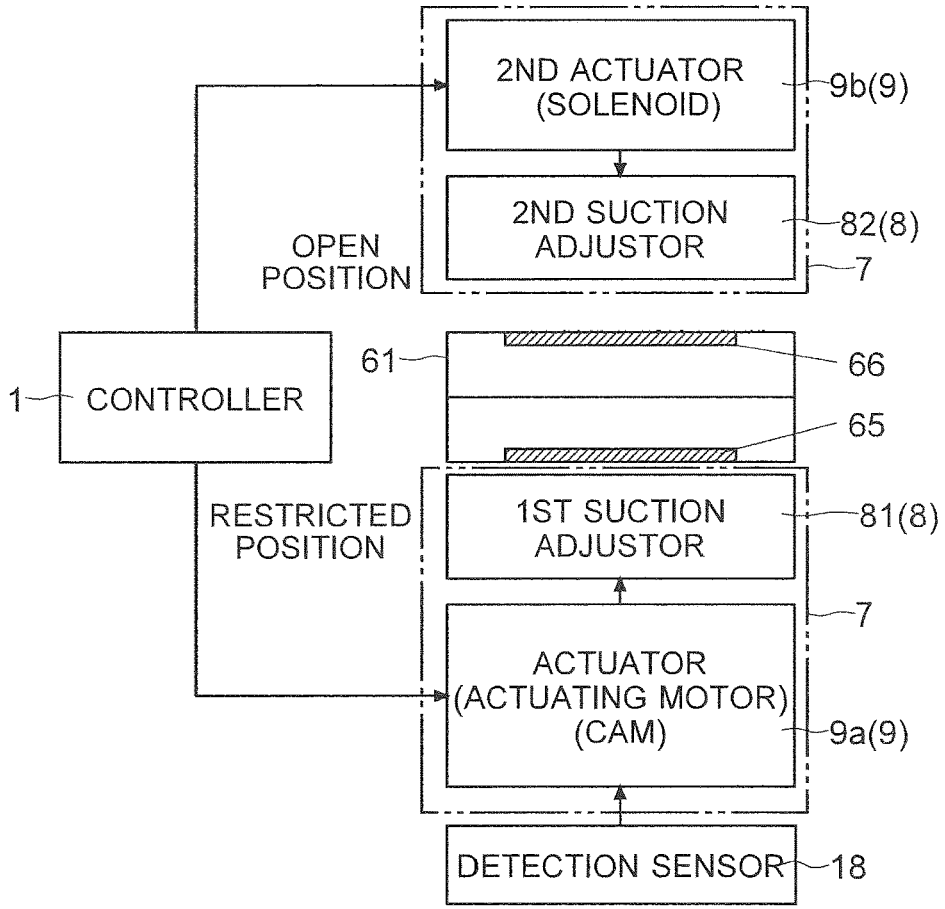
FIG. 14 is a diagram showing one example of wind amount adjustment data according to the first modified example.
FIG. 15 is a diagram showing one example of a suction adjustment mechanism according to a second modified example.

FIG. 14 shows one example of the wind amount adjustment data D1 in the first modified example. Based on the wind amount adjustment data D1 shown in FIG. 14, the controller 1 sets the position and the voltage.

For simplex printing on thin sheets, the controller 1 sets the suction adjustor 8 at the shut position and sets the motor voltage V1 at ½Vo (so that the amount of wind is minimal).

For duplex printing on thick sheets, the controller 1 sets the suction adjustor 8 at the open position and sets the motor voltage V1 at Vo (so that the amount of wind is maximal).

For simplex printing on thick or average sheets, the controller 1 can set the suction adjustor 8 at the open position and set the motor voltage V1 at ½Vo. Or, the controller 1 can set the suction adjustor 8 at the shut position and set the motor voltage V1 at Vo.

In simplex printing on thin sheets, duplex printing on thick sheets, and simplex printing on thick or average sheets, the position of the suction adjustor 8 and the level of the motor voltage V1 are the same as in the embodiment. On the other hand, they are different than in the embodiment in duplex printing on average sheets. For duplex printing on average sheets, the controller 1 sets the motor voltage V1 at Vo and sets the suction adjustor 8 at the restricted position.

With one suction port closed, the amount of wind is one-half of that with both suction ports open. With the motor voltage V1 at ½Vo, the amount of wind is one-half. At the restricted position, the amount of air sucked in through the first suction port 65, which is provided with the suction adjustor 8, is one-half as compared with at the open position. Here, let the amount of cooling wind for simplex printing on thin sheets (the minimal amount of wind) be 1. Then, the amount of cooling wind for simplex printing on thick or average sheets is 2. The amount of cooling wind for duplex printing on thick sheets is 4. Locating the suction adjustor 8 at the restricted position does not change the amount of air sucked in through the second suction port 66, but halves the amount of air sucked in through the first suction port 65. Thus, the total amount of air sucked in through the first and second suction ports 65 and 66 is 75% of that with the suction adjustor 8 at the open position. In duplex printing on average sheets, the amount of cooling wind is 3 (=4×0.75). In this way, it is possible to reduce the amount of wind for duplex printing on average sheets compared with that for duplex printing on thick sheets. It is thus possible to blow a necessary and sufficient amount of cooling wind onto average sheets.

The multifunction peripheral 100 (image forming apparatus) according to the first modified example includes a voltage adjuster 14. The voltage adjuster 14 varies the motor voltage V1 applied to the blower motor 64. The blower 61 has, as the suction port, a first suction port 65 and a second suction port 66. One of the first and second suction ports 65 and 66 is provided with the suction adjustor 8. The printing section 5 includes a duplex conveying unit 5*f*. The duplex conveying unit 5*f* guides a sheet printed on one side to upstream of the image forming unit 5*c* for duplex printing. The operation panel 4 accepts a setting as to whether to perform simplex printing or duplex printing. The controller 1 controls the voltage adjuster 14 and, based on the setting made on the operation panel 4, recognizes whether the sheets to be used in printing are thick, average, or thin sheets. For simplex printing on thin sheets, the controller 1 sets the suction adjustor 8 at a shut position and sets the motor voltage V1 lower than for duplex printing on thick sheets. For duplex printing on thick sheets, the controller 1 sets the suction adjustor 8 at an open position and sets the motor voltage V1 higher than for simplex printing on thin sheets. Thus, in simplex printing on thin sheets, the amount of cooling wind can be reduced to the minimal level. In duplex printing on thick sheets, the amount of air sucked in is increased and the motor voltage V1 is increased. Thus, the amount of cooling wind can be increased to the maximum level. It is possible to sufficiently cool thick sheets that have been printed on both sides. Moreover, it is possible to adjust the amount of wind by controlling two factors: the position of the suction adjustor 8 and the motor voltage V1. This helps increase the adjustment width of the amount of cooling wind. It is thus possible to increase the ratio of the maximal amount of wind to the minimal amount of wind.

On the other hand, for duplex printing on average sheets, the controller 1 sets the motor voltage V1 at the same voltage as that for duplex printing on thick sheets and sets the suction adjustor 8 at a restricted position, which is a position between the open position and the shut position and at which the amount of air sucked in is restricted as compared at the open position. For simplex printing on thick or average sheets, the controller 1 can set the suction adjustor 8 at the shut position and set the motor voltage V1 at the same voltage as in duplex printing on thick sheets. Or, for simplex printing on thick or average sheets, the controller 1 can set the motor voltage V1 at the same voltage as in simplex printing on thin sheets and set the suction adjustor 8 at the open position. It is thus possible to make the amount of cooling wind in duplex printing on average sheets smaller than in duplex printing on thick sheets but larger than in simplex printing on average sheets. It is thus possible to make the amount of cooling wind adequate to the amount of applied heat.

Second Modified Example: Next, with reference to FIGS. 15 and 16, a second modified example will be described. The following description focuses on differences from the embodiment and the first modified example described previously. For features common to the second modified example and the embodiment and the first modified example described previously, reference is to be made to the relevant parts of what has already been described, and no overlapping description will be repeated.

The second modified example differs from the embodiment and the first modified example described previously in that it is provided with two suction adjustors 8. A first suction adjustor 81 is provided for the first suction port 65. A second suction adjustor 82 is provided for the second suction port 66. The first suction adjustor 81 is biased in the direction away from the first suction port 65. The second suction adjustor 82 is biased in the direction away from the second suction port 66. These can be biased by use of biasing members (unillustrated) such as springs.

As the actuator 9, a first actuator 9*a* is provided for the first suction adjustor 81. As the actuator 9, a second actuator 9*b* is provided for the second suction adjustor 82. This is another difference from the embodiment and the first modified example described previously. For example, the first actuator 9*a* can be configured like the actuator 9 in the first modified example. The first actuator 9*a* can comprise a cam, or a worm gear. The first actuator 9*a* can keep the first suction adjustor 81 at one of an open position, a restricted position, and a shut position. As in the first modified example, a detection sensor that detects the position of the first suction adjustor 81 may be provided.

The second actuator 9*b* can be configured like the actuator 9 in the embodiment. The second actuator 9*b* can comprise a solenoid. The second actuator 9*b* can keep the suction adjustor 8 either at an open position or at a shut position. Instead, the first actuator 9*a* may be configured like the actuator 9 in the embodiment described previously, and the second actuator 9*b* may be configured like the actuator 9 in the first modified example.

FIG. 15 shows an example where the first suction adjustor 81 is located at the restricted position. FIG. 15 also shows an example where the second suction adjustor 82 is located at the open position. The restricted position in the second modified example is similar to that in the first modified example. The restricted position is a position at which the amount of air sucked in is 50% that at the open position. The controller 1 controls the first actuator 9*a*. The controller 1 can keep the first suction adjustor 81 at one of the open, restricted, and shut positions. The controller 1 controls the second actuator 9*b*. The controller 1 can keep the second suction adjustor 82 either at the open or shut position.

Also in the second modified example, in a print job, a process similar to the wind amount adjustment process shown in the flow chart in FIG. 11 is performed. In the second modified example, different wind amount adjustment data D1 is referred to at step #13.

FIG. 16 shows one example of the wind amount adjustment data D1 in the second modified example. Based on the wind amount adjustment data D1 shown in FIG. 16, the controller 1 sets the position and the voltage.

For simplex printing on thin sheets, the controller 1 sets the first suction adjustor 81 at the restricted position, sets the second suction adjustor 82 at the shut position, and sets the motor voltage V1 at ½Vo (so that the amount of wind is minimal).

For duplex printing on thick sheets, the controller 1 sets the first and second suction adjustors 81 and 82 at the open position and sets the motor voltage V1 at Vo (so that the amount of wind is maximal).

For duplex printing on average sheets, the controller 1 sets the first suction adjustor 81 at the restricted position, sets the second suction adjustor 82 at the open position, and sets the motor voltage V1 at Vo.

For simplex printing on thick or average sheets, the controller 1 can set one of the first and second suction adjustors 81 and 82 at the shut position and the other at the open position and set the motor voltage V1 at Vo.

Or, for simplex printing on thick or average sheets, the controller 1 can set the first and second suction adjustors 81 and 82 both at the open position and set the motor voltage V1 at ½Vo.

Let the amount of cooling wind for simplex printing on thin sheets be 1. Here, the amount of wind for simplex printing on thin sheets is one-half of that in the embodiment and the first modified example. Then, the amount of wind for simplex printing on thick or average sheets is 4. The amount of wind for duplex printing on average sheets is 6. The amount of wind for duplex printing on thick sheets is 8. In this way, it is possible to greatly reduce the amount of wind for simplex printing on thin sheets.

The amount of wind may be made different between for simplex printing on thick sheets and for simplex printing on average sheets. In that case, for simplex printing on average sheets, the controller 1 can set one of the first and second suction adjustors 81 and 82 at the open position and the other at the shut position and set the motor voltage V1 at ½Vo. Or, for simplex printing on average sheets, the controller 1 can set one of the first and second suction adjustors 81 and 82 at the restricted position and the other at the shut position and set the motor voltage V1 at Vo.

The multifunction peripheral 100 (image forming apparatus) according to the second modified example includes a voltage adjuster 14. The voltage adjuster 14 varies the motor voltage V1 applied to the blower motor 64. The blower 61 has, as the suction port, a first suction port 65 and a second suction port 66. A first suction adjustor 81 is provided for the first suction port 65. A second suction adjustor 82 is provided for the second suction port 66. As the actuator 9, a first actuator 9*a* and a second actuator 9*b* are provided. The first actuator 9*a* moves the first suction adjustor 81 between an open position and a shut position. The second actuator 9*b* moves the second suction adjustor 82 between an open position and a shut position. The printing section 5 includes a duplex conveying unit 5*f*. The duplex conveying unit 5*f* guides a sheet printed on one side to upstream of the image forming unit 5*c* for duplex printing. The operation panel 4 accepts a setting as to whether to perform simplex printing or duplex printing. The controller 1 controls the voltage adjuster 14 and the first and second actuators 9*a* and 9*b*. Based on the setting made on the operation panel 4, the controller 1 recognizes whether the sheets to be used in printing are thick, average, or thin sheets. For simplex printing on thin sheets, the controller 1 sets one of the first and second suction adjustors 81 and 82 at the shut position and the other at a restricted position and sets the motor voltage V1 lower than for duplex printing on thick sheets. The restricted position is a position between the open position and the shut position. The restricted position is a position at which the amount of air sucked in is restricted compared with at the open position. For duplex printing on thick sheets, the controller 1 sets the first and second suction adjustors 81 and 82 at the open position and sets the motor voltage V1 higher than for simplex printing on thin sheets.

Thus, in simplex printing on thin sheets, the amount of cooling wind can be reduced to the minimal level. In duplex printing on thick sheets, the amount of air sucked in is increased and the motor voltage V1 is increased. Thus, the amount of cooling wind can be increased to the maximum level. It is possible to sufficiently cool thick sheets that have been printed on both sides. Moreover, it is possible to adjust the amount of wind by controlling two factors: the position of the suction adjustor 8 and the motor voltage V1. This helps increase the adjustment width of the amount of cooling wind (increase the ratio of the maximal amount of wind to the minimal amount of wind).

On the other hand, for duplex printing on average sheets, the controller 1 sets one of first and second suction adjustors 81 and 82 at the open position and the other at the restricted position and sets the motor voltage V1 at the same voltage as that for duplex printing on thick sheets. For simplex printing on thick or average sheets, the controller 1 can set one of the first and second suction adjustors 81 and 82 at the shut position and the other at the open position and set the motor voltage V1 at the same voltage as for duplex printing on thick sheets. Or, for simplex printing on thick or average sheets, the controller 1 can set the motor voltage V1 at the same voltage as for simplex printing on thin sheets and set the first and second suction adjustors 81 and 82 at the open position. It is thus possible to make the amount of cooling wind in duplex printing on average sheets smaller than in duplex printing on thick sheets but larger than in simplex printing on average sheets. It is thus possible to set the amount of cooling wind adequate to the amount of applied heat.

The embodiments described above are not meant to limit the scope of the present disclosure, which can therefore be implemented with various modifications made within the spirit of the present disclosure.

The above description deals with an example where, of different levels of the motor voltage V1, the higher is set at Vo and the lower is set at ½Vo. Instead, the higher level of the motor voltage V1 may be any level other than 100% of Vo (for example, 80%), and the lower level of the motor voltage V1 may be any level other than 50% of Vo (for example, 40%).

The above description deals with an example where the position at which the amount of air sucked in through the first suction port 65 is 50% of that at the open position is taken as the restricted position. Instead, the restricted position may be any position at which the percentage of the amount of air sucked in is other than 50%.

What is claimed is:

1. An image forming apparatus, comprising:

an operation panel that accepts a setting as to a sheet to be used in printing;

a printing section including:

an image forming unit that forms a toner image and transfers the toner image to the sheet;

a fixing unit that heats the sheet having the toner image put thereon and fixes the toner image; and a conveying unit that conveys the sheet and discharges the sheet after fixing onto a discharge tray;

a cooling mechanism including:

a blower having:

a fan;

a suction port through which air is taken in;

a blower motor that rotates the fan; and a blowout port through which the air taken in through the suction port is blown out; and a blowing duct that guides the air blown out through the blowout port and blows the air onto the sheet that has passed through the fixing unit and is discharged out of the apparatus;

a suction adjustment mechanism including:

a suction adjustor that opens and closes the suction port; and an actuator that moves the suction adjustor between an open position at which the suction port is open and a shut position at which the suction port is closed, the suction adjustment mechanism adjusting an amount of air blown out through the blowout port by varying a position of the suction adjustor;

a controller that controls the actuator such that, the smaller a sheet thickness set on the operation panel, the closer the suction adjustor is to the shut position; and a voltage adjuster that varies a motor voltage applied to the blower motor, wherein the blower has, as the suction port, a first suction port and a second suction port, the suction adjustor is provided for one of the first and second suction ports, the printing section includes a duplex conveying unit that guides the sheet printed on one side to upstream of the image forming unit for duplex printing, the operation panel accepts a setting as to whether to perform simplex printing or duplex printing, the controller controls the voltage adjuster, the controller recognizes whether the sheet to be used in printing is a thick, average, or thin sheet based on the setting made on the operation panel, for simplex printing on the thin sheet, the controller sets the suction adjustor at the shut position and sets the motor voltage lower than for duplex printing on the thick or average sheet, and for duplex printing on the thick or average sheet, the controller sets the suction adjustor at the open position and sets the motor voltage higher than for simplex printing on the thin sheet.

2. The image forming apparatus of claim 1, wherein for simplex printing on the thick or average sheet, the controller either sets the suction adjustor at the shut position and sets the motor voltage at a same voltage as for duplex printing on the thick or average sheet or sets the suction adjustor at the open position and sets the motor voltage at a same voltage as for simplex printing on the thin sheet.

3. The image forming apparatus of claim 1, wherein the actuator includes a solenoid, and the controller moves the suction adjustor between the open position and the shut position by turning on and off the solenoid.

4. An image forming apparatus, comprising:

an operation panel that accepts a setting as to a sheet to be used in printing;

a printing section including:

an image forming unit that forms a toner image and transfers the toner image to the sheet;

a fixing unit that heats the sheet having the toner image put thereon and fixes the toner image; and a conveying unit that conveys the sheet and discharges the sheet after fixing onto a discharge tray;

a cooling mechanism including:

a blower having:

a fan;

a suction port through which air is taken in;

a blower motor that rotates the fan; and a blowout port through which the air taken in through the suction port is blown out; and a blowing duct that guides the air blown out through the blowout port and blows the air onto the sheet that has passed through the fixing unit and is discharged out of the apparatus;

a suction adjustment mechanism including:

a suction adjustor that opens and closes the suction port; and an actuator that moves the suction adjustor between an open position at which the suction port is open and a shut position at which the suction port is closed, the suction adjustment mechanism adjusting an amount of air blown out through the blowout port by varying a position of the suction adjustor;

a controller that controls the actuator such that, the smaller a sheet thickness set on the operation panel, the closer the suction adjustor is to the shut position; and a voltage adjuster that varies a motor voltage applied to the blower motor, wherein the blower has, as the suction port, a first suction port and a second suction port, the suction adjustor is provided for one of the first and second suction ports, the printing section includes a duplex conveying unit that guides the sheet printed on one side to upstream of the image forming unit for duplex printing, the operation panel accepts a setting as to whether to perform simplex printing or duplex printing, the controller controls the voltage adjuster, the controller recognizes whether the sheet to be used in printing is a thick, average, or thin sheet based on the setting made on the operation panel, for simplex printing on the thin sheet, the controller sets the suction adjustor at the shut position and sets the motor voltage lower than for duplex printing on the thick sheet, and for duplex printing on the thick sheet, the controller sets the suction adjustor at the open position and sets the motor voltage higher than for simplex printing on the thin sheet.

5. The image forming apparatus of claim 4, wherein for duplex printing on the average sheet, the controller sets the motor voltage at a same voltage as for duplex printing on the thick sheet and sets the suction adjustor at a restricted position, and for simplex printing on the thick or average sheet, the controller either sets the motor voltage at a same voltage as for duplex printing on the thick sheet and sets the suction adjustor at the shut position or sets the motor voltage at a same voltage as for simplex printing on the thin sheet and sets the suction adjustor at the open position, and the restricted position is a position which is located between the open position and the shut position and at which an amount of air sucked in is restricted compared with at the open position.

6. The image forming apparatus of claim 5, wherein the actuator includes an actuating motor and a cam, the cam rotates by being driven by the actuating motor and lies in contact with the suction adjustor, and the controller varies a distance between the one of the suction ports and the suction adjustor by controlling a rotation angle of the cam.

7. An image forming apparatus, comprising:

an operation panel that accepts a setting as to a sheet to be used in printing;

a printing section including:

an image forming unit that forms a toner image and transfers the toner image to the sheet;

a fixing unit that heats the sheet having the toner image put thereon and fixes the toner image; and a conveying unit that conveys the sheet and discharges the sheet after fixing onto a discharge tray;

a cooling mechanism including:

a blower having:

a fan;

a suction port through which air is taken in;

a blower motor that rotates the fan; and a blowout port through which the air taken in through the suction port is blown out; and a blowing duct that guides the air blown out through the blowout port and blows the air onto the sheet that has passed through the fixing unit and is discharged out of the apparatus;

a suction adjustment mechanism including:

a suction adjustor that opens and closes the suction port; and an actuator that moves the suction adjustor between an open position at which the suction port is open and a shut position at which the suction port is closed, the suction adjustment mechanism adjusting an amount of air blown out through the blowout port by varying a position of the suction adjustor;

a controller that controls the actuator such that, the smaller a sheet thickness set on the operation panel, the closer the suction adjustor is to the shut position a voltage adjuster that varies a motor voltage applied to the blower motor, wherein the blower has, as the suction port, a first suction port and a second suction port, the first suction port is provided with a first suction adjustor, the second suction port is provided with a second suction adjustor, as the actuator, a first actuator and a second actuator are provided, the first actuator moves the first suction adjustor between the open position and the shut position, the second actuator moves the second suction adjustor between the open position and the shut position, the printing section includes a duplex conveying unit that guides the sheet printed on one side to upstream of the image forming unit for duplex printing, the operation panel accepts a setting as to whether to perform simplex printing or duplex printing, the controller controls the voltage adjuster and a first and second actuators, the controller recognizes whether the sheet to be used in printing is a thick, average, or thin sheet based on the setting made on the operation panel, for simplex printing on the thin sheet, the controller sets, of the first and second suction adjustors, one at the shut position and another at a restricted position and sets the motor voltage lower than for duplex printing on the thick sheet, the restricted position is a position which is located between the open position and the shut position and at which an amount of air sucked in is restricted compared with at the open position, and for duplex printing on the thick sheet, the controller sets the first and second suction adjustors at the open position and sets the motor voltage higher than for simplex printing on the thin sheet.

8. The image forming apparatus of claim 7, wherein for duplex printing on the average sheet, the controller sets, of the first and second suction adjustors, one at the open position and another at the restricted position and sets the motor voltage at a same voltage as for duplex printing on the thick sheet, and for simplex printing on the thick or average sheet, the controller either sets, of the first and second suction adjustors, one at the shut position and another at the open position and sets the motor voltage at a same voltage as for duplex printing on the thick sheet, or sets the motor voltage at a same voltage as for simplex printing on the thin sheet and sets the first and second suction adjustors at the open position.

9. The image forming apparatus of claim 8, wherein the first actuator includes an actuating motor and a cam, the cam rotates by being driven by the actuating motor and lies in contact with the first suction adjustor, and the controller varies a distance between the first suction port and the first suction adjustor by controlling a rotation angle of the cam.

* * * * *